US010385655B2

(12) United States Patent
Stæhr

(10) Patent No.: US 10,385,655 B2
(45) Date of Patent: Aug. 20, 2019

(54) DOWNHOLE FLOW CONTROL DEVICE

(71) Applicant: Welltec Oilfield Solutions AG, Zug (CH)

(72) Inventor: Lars Stæhr, Allerød (DK)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 113 days.

(21) Appl. No.: 15/322,563

(22) PCT Filed: Jun. 29, 2015

(86) PCT No.: PCT/EP2015/064704
§ 371 (c)(1),
(2) Date: Dec. 28, 2016

(87) PCT Pub. No.: WO2016/001141
PCT Pub. Date: Jan. 7, 2016

(65) Prior Publication Data

US 2017/0122066 A1 May 4, 2017

(30) Foreign Application Priority Data

Jun. 30, 2014 (EP) ..... 14174961

(51) Int. Cl.

| | |
|---|---|
| ***E21B 34/06*** | (2006.01) |
| ***E21B 43/26*** | (2006.01) |
| ***E21B 34/14*** | (2006.01) |
| ***E21B 34/00*** | (2006.01) |
| ***E21B 33/124*** | (2006.01) |

(52) U.S. Cl.
CPC ..... *E21B 34/06* (2013.01); *E21B 33/1243* (2013.01); *E21B 34/14* (2013.01); *E21B 43/26* (2013.01); *E21B 2034/007* (2013.01)

(58) Field of Classification Search
CPC .... E21B 34/06; E21B 33/127; E21B 33/1243; E21B 43/26; E21B 34/14; E21B 2034/007
See application file for complete search history.

(56) References Cited

U.S. PATENT DOCUMENTS 3,051,243 A 8/1962 Grimmer et al.
3,071,193 A 1/1963 Raulins
(Continued)

FOREIGN PATENT DOCUMENTS

EP 0 224 942 6/1987
RU 2 305 170 C2 8/2007
(Continued)

OTHER PUBLICATIONS

International Search Report and Written Opinion of the ISA for PCT/EP2015/064704, dated Nov. 17, 2015, 21 pages.
(Continued)

*Primary Examiner* — Michael R Wills, III
(74) *Attorney, Agent, or Firm* — Nixon & Vanderhye P.C.

(57) ABSTRACT

The present invention relates to a downhole flow control device for controlling a flow of a fluid from a borehole into a well tubular structure and/or from the well tubular structure into the borehole, comprising a base tubular having an axial axis and adapted to be mounted as part of the well tubular structure, the base tubular having a first opening, a first sleeve arranged within the base tubular, the first sleeve having a first sleeve part and a second sleeve part with a second opening, and the first sleeve being adapted to slide along the axial axis for at least partly aligning the first opening with the second opening, wherein a second sleeve is arranged at least partly between the second sleeve part and the base tubular, and an engagement element is arranged for engaging an indentation of the second sleeve part in a first position and for disengaging the indentation of the second sleeve part in a second position. Furthermore the present invention relates to a downhole system.

19 Claims, 6 Drawing Sheets

(56) References Cited

U.S. PATENT DOCUMENTS

| | | | | |
|---|---|---|---|---|
| 4,669,541 | A * | 6/1987 | Bissonnette | E21B 34/14 166/154 |
| 4,949,788 | A | 8/1990 | Szarka et al. | |
| 6,422,317 | B1 * | 7/2002 | Williamson, Jr. | E21B 34/10 166/320 |
| 2002/0074128 | A1 | 6/2002 | Allamon et al. | |
| 2007/0240883 | A1 | 10/2007 | Telfer | |
| 2012/0325500 | A1 | 12/2012 | Moen | |

FOREIGN PATENT DOCUMENTS

| | | | |
|---|---|---|---|
| RU | 2 507 375 | C1 | 2/2014 |
| SU | 817212 | | 3/1981 |
| SU | 1213175 | A | 2/1986 |
| SU | 1709070 | A1 | 1/1992 |
| WO | WO 2013/150304 | A2 | 10/2013 |

OTHER PUBLICATIONS

Extended Search Report for EP 14174961.4 dated Apr. 10, 2015, 11 pages.

Office Action of Substantive Examination dated Feb. 8, 2019 in Russian Application No. 2017100123/03(000287), with English Translation, 12 pages.

Communication Pursuant to Rule 164(2)(b) and Article 94(3) EPC dated Dec. 14, 2018 in European Application No. 15 731 378.4, 10 pages.

* cited by examiner

DOWNHOLE FLOW CONTROL DEVICE

This application is the U.S. national phase of International Application No. PCT/EP2015/064704 filed 29 Jun. 2015 which designated the U.S. and claims priority to EP Patent Application No. 14174961.4 filed 30 Jun. 2014, the entire contents of each of which are hereby incorporated by reference.

FIELD OF THE INVENTION

The present invention relates to a downhole flow control device for controlling a flow of a fluid from a borehole into a well tubular structure and/or from the well tubular structure into the borehole. Furthermore the present invention relates to a downhole system.

BACKGROUND ART

When valves, frac ports and inflow control devices are arranged as part of a well tubular structure downhole, it is often experienced that scales and debris are settling in openings of the valves, ports and devices. In particular, this is experienced inside the well tubular structure, causing the flow area in the openings to be decreased and in some circumstances even closed for flow, resulting in the valves, ports and devices not functioning properly.

Furthermore, as scales and debris are settling in the openings of the valves, ports and inflow control devices, sealing elements arranged in connection with the openings may be damaged, and this may disadvantageously lead to leakage from the valves, ports or devices, even in circumstances where they are supposed to be closed.

SUMMARY OF THE INVENTION

It is an object of the present invention to wholly or partly overcome the above disadvantages and drawbacks of the prior art. More specifically, it is an object to provide an improved downhole flow control device minimising the risk of scales and debris settling, and hence opening and closing of the flow control device is facilitated.

The above objects, together with numerous other objects, advantages and features, which will become evident from the below description, are accomplished by a solution in accordance with the present invention by a downhole flow control device for controlling a flow of a fluid from a borehole into a well tubular structure and/or from the well tubular structure into the borehole, comprising:

- a base tubular having an axial axis and adapted to be mounted as part of the well tubular structure, the base tubular having a first opening.
- a first sleeve arranged within the base tubular, the first sleeve having a first sleeve part and a second sleeve part with a second opening, and the first sleeve being adapted to slide along the axial axis for at least partly aligning the first opening with the second opening, wherein a second sleeve is arranged at least partly between the second sleeve part and the base tubular, and an engagement element is arranged for engaging an indentation of the second sleeve part in a first position and for disengaging the indentation of the second sleeve part in a second position.

The second sleeve may be engaged with the second sleeve part in the first position and is disengaged from the second sleeve part in the second position.

The first position may be an initial position of the downhole flow control device.

Moreover, the second sleeve may have a through-going bore in which the engagement element is arranged.

Further, the base tubular may have an elongated projection extending along the axial axis for pressing the engagement element in engagement with the second sleeve until reaching the second position.

Also, the base tubular may have a recess for receiving the engagement element at the second position.

Additionally, the downhole control device may be configured to open the first opening by movement of the first sleeve and the second sleeve in a first direction along the axial axis and to close the first opening by movement of the first sleeve and the second sleeve in a second direction, the second direction being the opposite direction in relation to the first direction, along the axial axis.

The recess may have a first recess end and a second recess end, the second recess end being closest to the first opening, the first recess end having a first end face which is inclined and the second recess end having a second end face extending in a direction substantially perpendicular to the axial axis.

Moreover, the second sleeve may be prevented from sliding past the first opening when the engagement element is in engagement in the recess and abuts the second end face.

Furthermore, the inclined first end face of the recess may be configured to disengage the engagement element from the recess by the engagement element sliding up from the recess along the movement of the second sleeve in the second direction.

Additionally, the engagement element may be spring-loaded.

The engagement element may be a spring-loaded circlip.

Furthermore, the engagement element may comprise a spring.

Said spring may be a leaf spring.

Also, the downhole flow control device may comprise a plurality of engagement elements.

The downhole flow control device as described above may further comprise a first sealing element and a second sealing element, the first sealing element being arranged in a first circumferential groove in the base tubular on a first side of the first opening and the second sealing element being arranged in a second circumferential groove in the base tubular on a second side of the first opening, the second side being opposite the first side.

Furthermore, the sealing elements may be chevron seals.

Additionally, the first sealing element may be arranged between the first sleeve part and the base tubular, and the second sealing element may be arranged between the first sleeve part and the base tubular in the first position and between the second sleeve and the base tubular in the second position.

The second sleeve part may comprise a plurality of second openings.

In addition, the first sleeve part and the second sleeve part may be produced as one sleeve.

Further, the first sleeve part may be a third sleeve which may be connected with the second sleeve part.

Moreover, the third sleeve may be arranged between the second sleeve part and the base tubular.

The first sleeve part may have a first end and a second end, and the second sleeve may have a first end and a second end, the first end of the first sleeve part abutting the second end of the second sleeve in the first position.

Also, a gap may be formed between the second end of the second sleeve and the first end of the first sleeve part when the second sleeve is prevented from movement in the first direction and the first sleeve part continues to move past the first opening, whereby fluid communication between the first opening and the second opening is provided via the gap.

Furthermore, the second sleeve part may have an inner face and a groove in the inner face for engagement with a key tool of a downhole tool.

Additionally, the base tubular may be mounted from at least two tubular sections.

Moreover, the first opening may be smaller than the second opening.

The flow control device may be a frac port or an inflow control device or a valve.

Further, the openings may be through-going.

The present invention also relates to a downhole system for controlling a flow of a fluid from a borehole into a well tubular structure and/or from the well tubular structure into the borehole, comprising a well tubular structure, and a downhole flow control device as described above.

The downhole system as described above may further comprise an annular barrier, the annular barrier comprising:

- a tubular part adapted to be mounted as part of the well tubular structure, the tubular part having an outer face,
- an expandable sleeve surrounding the tubular part and having an inner sleeve face facing the tubular part and an outer sleeve face facing the wall of the borehole, each end of the expandable sleeve being connected with the tubular part, and
- an annular space between the inner sleeve face of the expandable sleeve and the tubular part.

Furthermore, the annular barrier may be a first annular barrier and the system as described above may further comprise a second annular barrier, both adapted to be expanded in an annulus between the well tubular structure and a wall of the borehole or another well tubular structure downhole for providing zone isolation of a production zone positioned between the first and second annular barriers, the downhole flow control device being arranged opposite the production zone.

Moreover, one or both ends of the expandable sleeve may be connected with the tubular part by means of connection parts.

Furthermore, the expandable sleeve may be made of metal.

In addition, the tubular part may be made of metal.

Further, an opening may be arranged in the tubular part.

Additionally, sealing means may be arranged between the connection part and the tubular part or between the end of the expandable sleeve and the tubular part.

Moreover, the annular space may comprise a second sleeve.

The downhole system may comprise a plurality of flow control devices.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
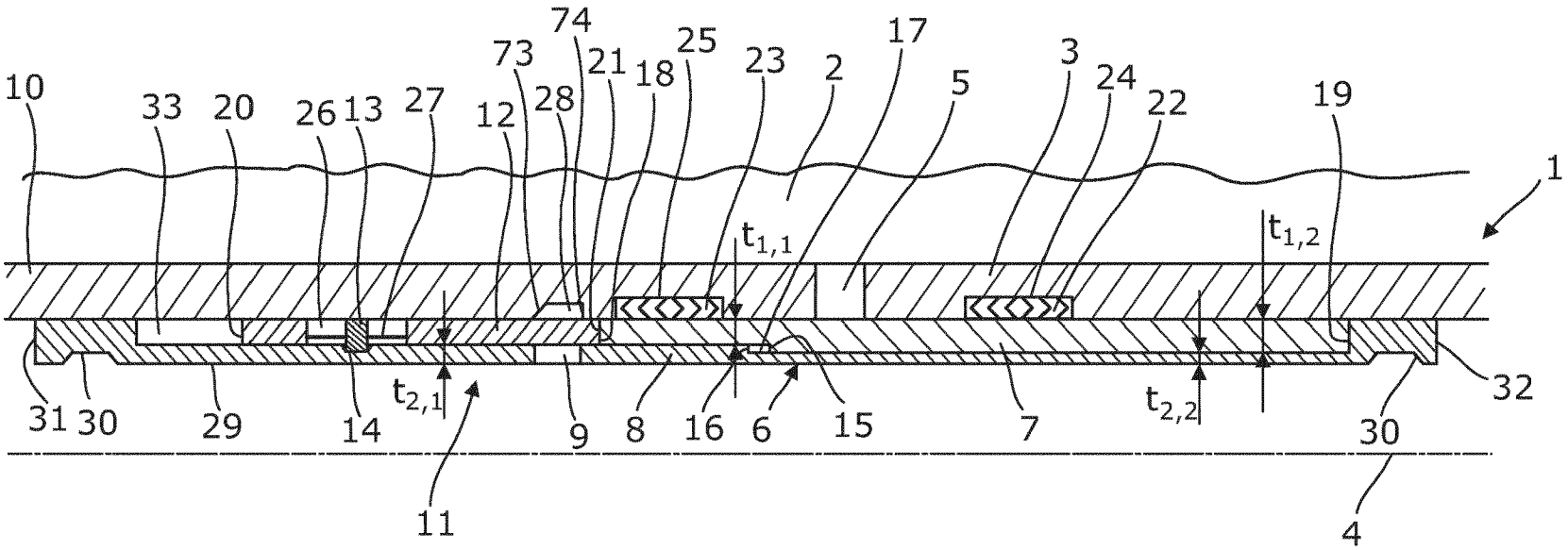
FIGS. 1-3 show, in a cross-sectional view, the downhole flow control device according to the present invention in different positions.

FIG. 1 shows an embodiment of a downhole flow control device 1 according to the present invention in a cross-sectional view. The downhole flow control device 1 is adapted to control a flow of a fluid from a borehole 2 into a well tubular structure 10 and/or from the well tubular structure 10 into the borehole 2.

The downhole flow control device 1 comprises a base tubular 3 having an axial axis 4 and being adapted to be mounted as part of the well tubular structure 10, the base tubular 3 having a first opening 5. The first opening 5 is arranged opposite the borehole 2. The downhole flow control device 1 furthermore comprises a first sleeve 6 which is arranged within the base tubular 3. The first sleeve 6 has a first sleeve part 7 and a second sleeve part 8 with a second opening 9. The first sleeve 6 is adapted to slide along the axial axis 4 for at least partly aligning the first opening 5 with the second opening 9, so that fluid communication may be provided between the borehole 2 and an inside 11 of the well tubular structure 10. Accordingly, the downhole control device 1 is configured to open the first opening 5 by movement of the first sleeve 6 and the second sleeve 12 in a first direction along the axial axis 4 and to close the first opening 5 by movement of the first sleeve 6 and the second sleeve 12 in a second direction, the second direction being the opposite direction in relation to the first direction, along the axial axis 4.

Figure 2:
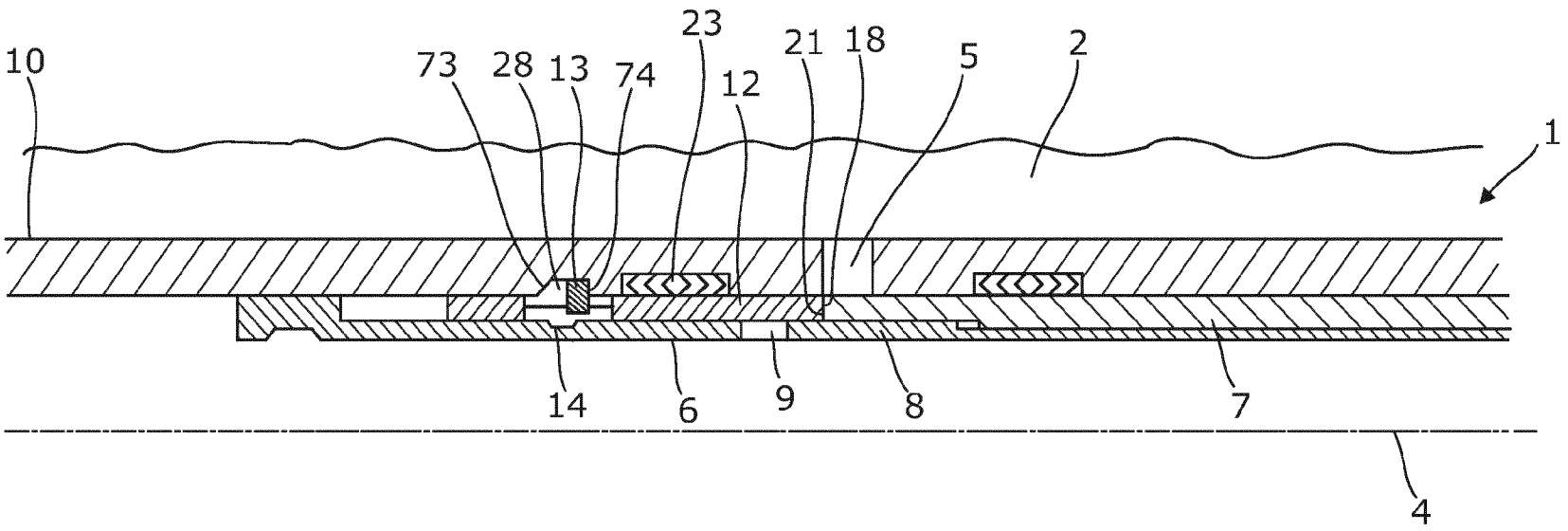
Figure 3:
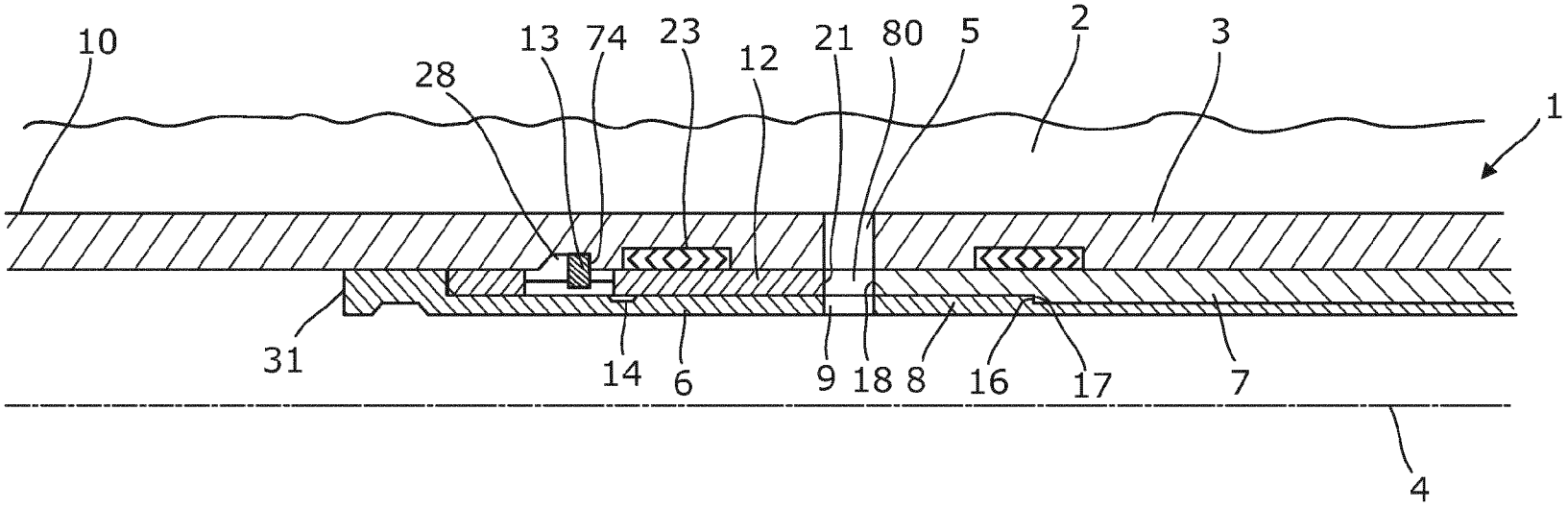

Furthermore, a second sleeve 12 is arranged at least partly between the second sleeve part 8 and the base tubular 3, and an engagement element 13 is arranged for engaging an indentation 14 of the second sleeve part 8 in a first position which is the position shown in FIG. 1. In the first position, the first and second openings are unaligned and the downhole flow control device 1 is in its closed position in which no well fluid is allowed to flow into the well tubular structure. The engagement element 13 is furthermore adapted to disengage the indentation 14 of the second sleeve part 8 in a second position when the first and second sleeves 6, 12 have been slid along the axis 4 in relation to the base tubular. The second position is shown in FIGS. 2 and 3.

When the engagement element 13 is engaged in the indentation 14 of the second sleeve part 8, the second sleeve 12 will slide along the axial axis 4 together with the first sleeve 6, until the engagement element 13 disengages the indentation 14, causing the first sleeve 6 to be capable of sliding further along the axial axis 4 without the second sleeve 12 following along.

When the downhole flow control device 1 is in its closed position, the first and second sleeve abut each other, preventing scale or debris from precipitating as there is no opening therebetween to precipitate in. Hence, the disadvantages with scales and other debris settling in the openings and thereby minimising or even closing off the flow possibilities through the openings when these are aligned, are eliminated, as the opening is not created until the first sleeve is moved away from the second sleeve.

In addition, the downhole flow control device 1 also comprises a first sealing element 22 and a second sealing element 23. The first sealing element 22 is arranged in a first circumferential groove 24 in the inner face of the base tubular 3 on a first side of the first opening 5. The second sealing element 23 is arranged in a second circumferential groove 25 in the base tubular 3 on a second side of the first opening 5, where the second side is opposite the first side. Preferably, the sealing elements 22, 23 are chevron seals.

The first sealing element 22 is arranged between the first sleeve part 7 and the base tubular 3. The second sealing element 23 is arranged between the first sleeve part 7 and the base tubular 3 in the first position, as shown in FIG. 1, and between the second sleeve 12 and the base tubular 3 in the second position, as shown in FIG. 3. Due to the fact that the first sleeve and the second sleeve abut each other when passing the second sealing elements, risk of the sealing elements being damaged is minimised, and it is hence obtained that their sealing properties are maintained, since the opening is not created until the second sleeve has passed the second sealing element 23.

The embodiment of FIG. 1 shows that the first sleeve part 7 and the second sleeve part 8 are two separate elements. The first sleeve part 7 has a first thickness $t_{1,1}$ and a second thickness $t_{1,2}$, the second thickness being larger than the first thickness. Between the first thickness and the second thickness a first wall 15 is arranged. The first thickness is positioned closest to the second sleeve 12.

In the same manner, the second sleeve part 8 has a first thickness $t_{2,1}$ and a second thickness $t_{2,2}$, the first thickness being larger than the second thickness. The second opening 9 is positioned in the part of the second sleeve part 8 having the first thickness $t_{2,1}$. Between the first thickness $t_{2,1}$ and the second thickness $t_{2,2}$ a second wall 16 is arranged. The first wall 15 and the second wall 16 are positioned opposite each other, with a distance between them defining a cavity 17 as shown in FIG. 1. The second sleeve part 8 is, in the shown embodiment, capable of sliding along the axial axis 4 independently of the first sleeve part 7 until the second wall 16 abuts the first wall. This will be described further below in connection with FIGS. 2 and 3.

Furthermore, the first sleeve part 7 has a first end 18 and a second end 19 and the second sleeve 12 has a first end 20 and a second end 21, the first end 18 of the first sleeve part 7 abutting the second end 21 of the second sleeve 12 in the first position as shown in FIG. 1. Hereby the second sleeve 12 may assist in sliding the first sleeve part 7 when the second sleeve part 8 is connected to the second sleeve 12 via the engagement element 13 and the second sleeve part 8 is moved along the axial axis 4.

In FIG. 1, the first sleeve part 7 is a third sleeve 7 which abuts the second sleeve part 8, the first sleeve part 7 and the second sleeve part 8 yet still being slidable in relation to each other. The third sleeve 7 is arranged between the second sleeve part 8 and the base tubular 3.

The second sleeve 12 of FIG. 1 has a through-going bore 26 in which the engagement element 13 is arranged. The engagement element 13 has a length which is larger than a thickness of the second sleeve 12. The through-going bore 26 is considerably larger than the width of the engagement element 13, so that a spring 27 may be arranged in connection with the engagement element 13. The spring 27 exerts a force on the engagement element 13 towards the base tubular 3, whereby the engagement element 13 is spring-loaded when engaging the indentation 14 in the second sleeve part 8 and will disengage the indentation 14 as soon as it is possible for the engagement element 13 to move in a radial direction away from the axial axis 4. In FIG. 1, the spring 27 is a leaf spring; however, other springs may be used such as for instance a helical spring arranged around the engagement element 13.

The base tubular 3 has a recess 28 arranged opposite the second sleeve 12. The recess 28 is adapted to receive the engagement element 13 at the second position as shown in FIGS. 2 and 3. Thus, when the sleeves 6, 12 are slid along the axial axis 4, the engagement element 13 is maintained in engagement with the indentation 14 until it reaches the recess 28, causing the spring-loaded engagement element 13 to be forced in the radial direction, hence disengaging the indentation 14 by engaging the recess 28.

Figure 5:
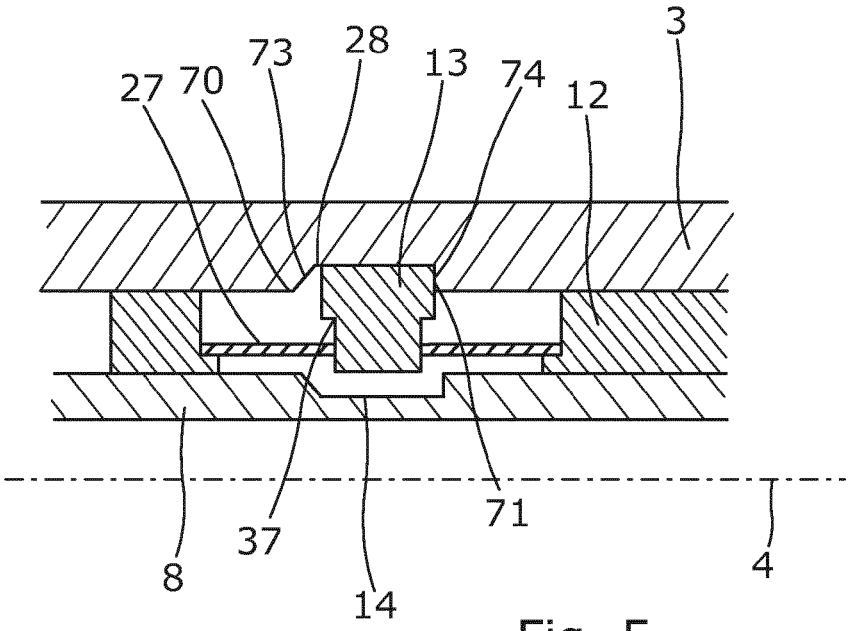

With reference to FIG. 5, the recess 28 has a first recess end 70 and a second recess end 71, the second recess end 71 being closest to the first opening (not shown in FIG. 5). The first recess end 71 has a first end face 73 which is inclined and the second recess end 71 has a second end face 74 extending in a direction substantially perpendicular to the axial axis 4. The inclined first end face 73 of the recess 28 is configured to disengage the engagement element 13 from the recess 28 by the engagement element 13 sliding up via the inclined first end face 73 from the recess 28 during the movement of the second sleeve 12 in the second direction.

Furthermore, with reference to FIG. 1 the second sleeve part 8 has an inner face 29 and at least one groove 30 in the inner face 29 for engagement with a key tool of a downhole tool (not shown). In FIG. 1, the second sleeve part 8 has a first end 31 and a second end 32, and a groove 30 is arranged in each end. At the first end 31 of the second sleeve part 8, an inside groove 33 is arranged between the second sleeve 12 and the first end 31, causing the second sleeve part 8 to be capable of moving in relation to the second sleeve 12 when the engagement element 13 has disengaged the indentation 14 in the second sleeve part 8.

In the cross-sectional view of the downhole flow control device 1 shown in FIG. 1, only a single engagement element 13 is shown. However, a plurality of engagement elements 13 may be arranged in the downhole flow control device.

The first, second and third sleeves and the first and second sleeve parts may be made of metal.

In FIG. 2, the first sleeve 6 of the downhole flow control device 1 of FIG. 1 is shown in an intermediate position which is the second position of the second sleeve.

In FIG. 3, the first sleeve 6 of the downhole flow control device 1 is shown in a third position and open position of the downhole flow control device 1 in which the first and second openings are aligned.

In this intermediate second position, the first and second sleeve parts 7, 8 and the second sleeve 12 have been moved to the right until the engagement element 13 has reached the recess 28, whereby the engagement element 13 disengages the indentation 14 of the second sleeve part 8 and at the same time engages the recess 28.

The second end 21 of the second sleeve 12 is still in this intermediate position abutting the first end 18 of the first sleeve part 7, whereby the second sleeve has pushed the first sleeve part 7 to this position. The second end 21 of the second sleeve 12 is arranged substantially at the first opening 5. In fact, the second sleeve 12 is prevented from sliding past the first opening 5 when the engagement element 13 is in engagement in the recess 28 and abuts the second end face 74 of the recess 28. In this intermediate position, the second sealing element 23 is arranged opposite the second sleeve 12.

In the intermediate position shown in FIG. 2, the first opening 5 is not aligned with the second opening 9 of the second sleeve part 8, whereby no fluid communication between the borehole 2 and the well tubular structure 10 is provided.

In FIG. 3, the downhole flow control device 1 is shown in the third position, wherein the first opening 5 is aligned with the second opening 9, so that fluid communication between the borehole 2 and the well tubular structure 10 is provided.

As shown in FIG. 3, a gap 80 is formed between the second end 21 of the second sleeve 12 and the first end 18 of the first sleeve part 7 when the second sleeve 12 is prevented from movement in the first direction, since the engagement element 13 is abutting the second end face of the recess and the first sleeve part 7 continues to move past the first opening 5, whereby fluid communication between the first opening 5 and the second opening 9 is provided via the gap 80.

With reference to the intermediate position shown in FIG. 2, the second sleeve part 8 has been disengaged from the second sleeve 12 and has been moved further to the right. The engagement element 13 has engaged the recess 28, whereby the second sleeve 12 is prevented from moving further to the right as described above.

When the second sleeve part 8 of the first sleeve is moved along the axial axis without the second sleeve 12, the wall 16 of the second sleeve part will, after a little distance, abut the wall 15 of the first sleeve part 7, whereby the second sleeve part 8 will push the first sleeve part 7. Thus, the first sleeve part 7 will start moving away from the second sleeve 12, and thereby a distance between the second sleeve 12 and the first sleeve part 7 will be provided. Furthermore, the second opening 9 will also be moved towards the position of the first opening 5 and these two openings will then be aligned, providing fluid communication between the borehole 2 and the well tubular structure 10. When moving the first sleeve away from the second sleeve, a circumferential opening between them is created, and when the second opening 9 is aligned with the first opening 5, the openings are also aligned with the circumferential opening between the sleeves 6, 12.

Furthermore, the first end 31 of the second sleeve part 8 has been moved towards the second sleeve 12 by minimising the inside groove 33. In FIG. 3, the first end 31 abuts the end of the second sleeve 12 facing the first end 31 of the second sleeve part 8.

In FIGS. 1-3, the first opening 5 and the second opening 9 have substantially the same width along the axial axis 4. However, in FIG. 6, the second opening 9 has a larger width than the first opening 5, so that if scale or debris precipitate, the second opening is just minimised but not minimised to be smaller than the first opening 5.

Even though not shown, the second sleeve part 8 may comprise a plurality of second openings, and the base tubular 3 may also comprise a plurality of first openings.

Figure 4:
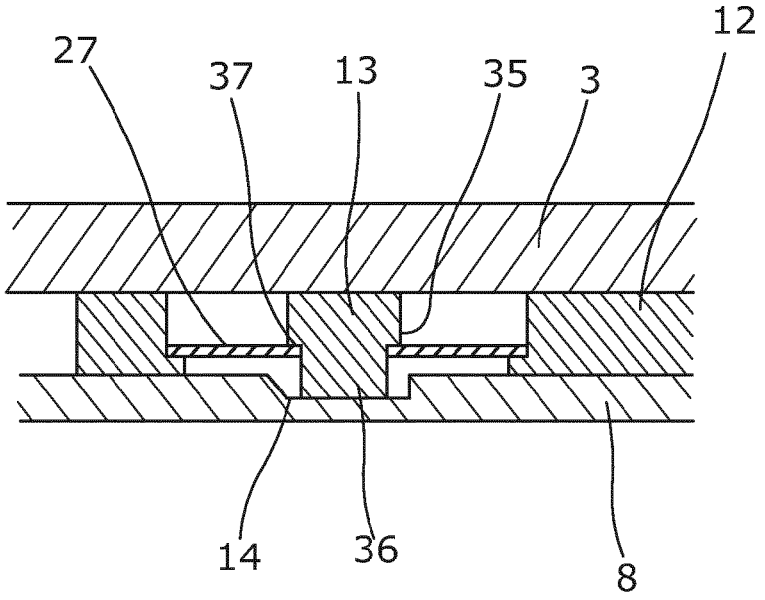
FIGS. 4-5 show enlarged partial cross-sectional views of an engagement element in an engaged position in an indentation and in a disengaged position.

In FIG. 4, an enlarged partial view of the engagement element 13 is shown engaged in the indentation 14 of the second sleeve part 8. In this position, the second sleeve 12 is connected with the second sleeve part 8 and thereby follows the second sleeve part 8 when the second sleeve part 8 is being moved.

The engagement element 13 comprises a first element part 35 and a second element part 36. The first element part 35 has a larger width than the second element part 36 which defines a protrusion 37 between the two element parts 35, 36. This protrusion is adapted for receiving the spring 27 so that the spring 27 exerts a force against the protrusion 37 in order to force the engagement element 13 in a radial outwards direction which is the upwards direction in FIG. 4 and away from the indentation 14. However, the engagement element 13 is prevented from disengaging the indentation due to the wall of the base tubular 3.

In FIG. 5, the second sleeve part 8 has been moved to the second position as shown in FIG. 2, where the engagement element 13 is positioned opposite the recess 28 in the base tubular 3. In this position the spring 27 forces the engagement element 13 radially outwards into the recess 28 and thereby the engagement element 13 disengages the indentation 14. Consequently, the connection between the second sleeve 12 and the second sleeve part 8 is disengaged, whereby the second sleeve part 8 may be moved independently of the second sleeve 12, and the second sleeve 12 is then securely positioned in relation to the base tubular 3 since the engagement element 13 has engaged the recess 28.

When the fluid communication between the borehole and the well tubular structure shall be closed, the above-mentioned provision of fluid communication is performed in reverse order.

Even though not shown, the base tubular may be mounted from at least two tubular sections.

Figure 6:
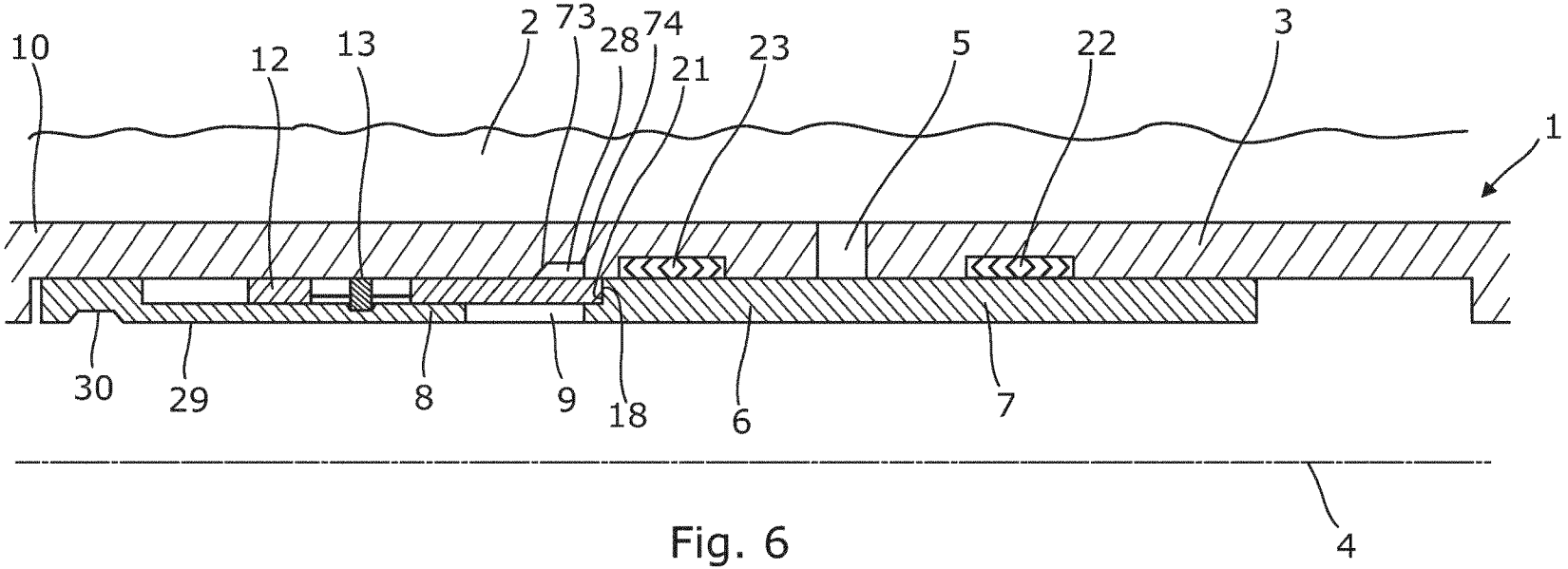
FIG. 6 shows in a cross-sectional view another downhole flow control device.

In FIG. 6, the first sleeve part 7 and the second sleeve part 8 is produced as one sleeve 6. The procedure of aligning the first opening 5 in the base tubular 3 with the second opening 9 in the second sleeve part 8 for providing fluid communication between the borehole 2 and the well tubular structure 10, is performed in substantially the same manner as described above in connection with the embodiment shown in FIGS. 1-3, except from the first sleeve part 7 and the second sleeve part 8 not being able to move independently of each other. The downhole flow control device 1 may be arranged within an inside groove or cavity of the well tubular structure 10 as shown in FIG. 6.

In addition, the base tubular may have an elongated projection extending along the axial axis for pressing the engagement element in engagement with the second sleeve and the second sleeve part until reaching the second position, and then the elongated projection ends and the engagement element disengages the second sleeve part. Also, the engagement element may be a spring-loaded circlip.

The flow control device 1 according to the present invention may be a frac port or an inflow control device or a valve.

Figure 7:
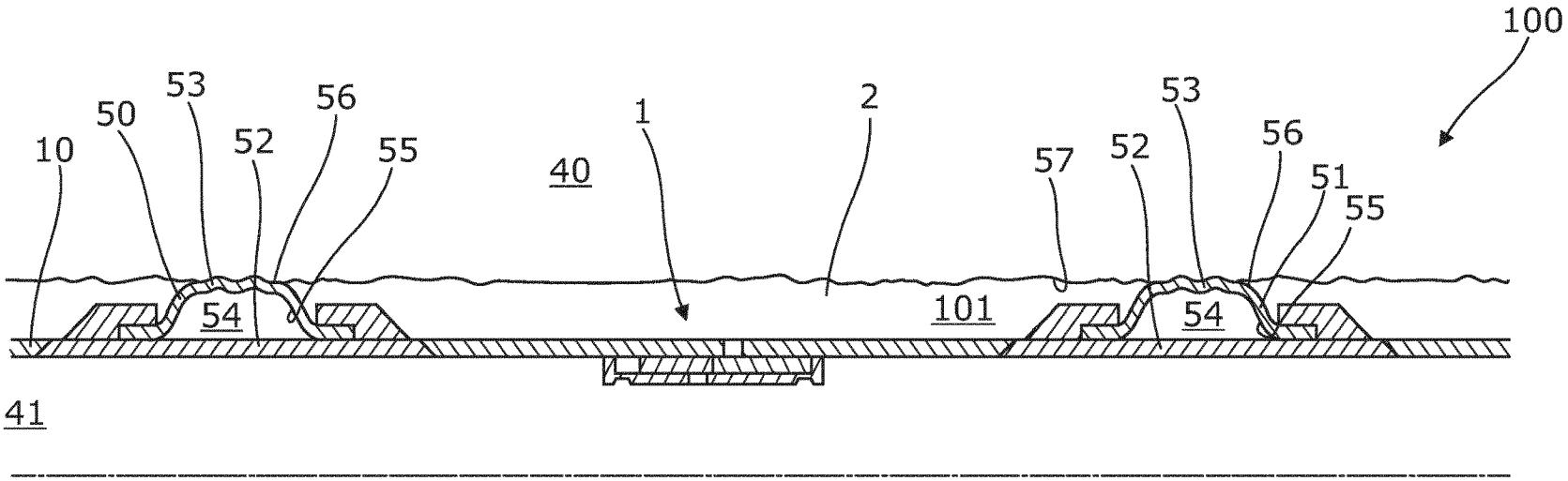
FIG. 7 shows a downhole system.

FIG. 7 shows a downhole system 100 for producing hydrocarbon-containing fluid from a reservoir 40 downhole. The downhole well system 100 comprises a well tubular structure 10 having an inside 41 for conducting the well fluid to surface.

The downhole system 100 comprises a first annular barrier 50 and a second annular barrier 51 to isolate a production zone 101 when the annular barriers are expanded. Each annular barrier comprises a tubular part 52 adapted to be mounted as part of the well tubular structure 10 by means of a thread, an expandable metal sleeve 53 surrounding the tubular part and an annular space 54 between the inner sleeve face of the expandable sleeve and the tubular part. The expandable metal sleeve 53 has an inner sleeve face 55 facing the tubular part and an outer sleeve face 56 facing a wall 57 of a borehole 2, each end of the expandable sleeve being connected with the tubular part, which provides the isolating barrier when the expandable sleeve is expanded.

The downhole system 100 further comprises a downhole flow control device 1 mounted as part of the well tubular structure 10 and arranged between the first and the second annular barriers opposite the production zone 101 for controlling a flow of a fluid from the borehole 2 into the well tubular structure 10 and/or from the well tubular structure 10 into the borehole 2.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, production casing or well tubular structure is meant any kind of pipe, tubing, tubular, liner, string etc. used downhole in relation to oil or natural gas production. The well tubular structure may be made of metal.

In the event that the tool is not submergible all the way into the well tubular structure, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole flow control device for controlling a flow of a fluid from a borehole into a well tubular structure and/or from the well tubular structure into the borehole, comprising:

a base tubular having an axial axis and adapted to be mounted as part of the well tubular structure, the base tubular having a first opening, a first sleeve arranged within the base tubular, the first sleeve having a first sleeve part and a second sleeve part with a second opening, and the first sleeve being adapted to slide along the axial axis for at least partly aligning the first opening with the second opening, wherein a second sleeve is arranged at least partly between the second sleeve part and the base tubular, and an engagement element is arranged for engaging an indentation of the second sleeve part in a first position and for disengaging the indentation of the second sleeve part in a second position, wherein the second sleeve is engaged with the second sleeve part in the first position and is disengaged from the second sleeve part in the second position.

2. The downhole flow control device according to claim 1, wherein the second sleeve has a through-going bore in which the engagement element is arranged.

3. The downhole flow control device according to claim 1, wherein the base tubular has a recess for receiving the engagement element at the second position.

4. The downhole flow control device according to claim 1, wherein the downhole control device is configured to open the first opening by movement of the first sleeve and the second sleeve in a first direction along the axial axis and to close the first opening by movement of the first sleeve and the second sleeve in a second direction, the second direction being the opposite direction in relation to the first direction, along the axial axis.

5. The downhole flow control device according to claim 3, wherein the recess has a first recess end and a second recess end, the second recess end being closest to the first opening, the first recess end having a first end face which is inclined and the second recess end having a second end face extending in a direction substantially perpendicular to the axial axis.

6. The downhole flow control device according to claim 5, wherein the second sleeve is prevented from sliding past the first opening when the engagement element is in engagement in the recess and abuts the second end face.

7. The downhole flow control device according to claim 5, wherein the inclined first end face of the recess is configured to disengage the engagement element from the recess by the engagement element sliding up from the recess during the movement of the second sleeve in the second direction.

8. The downhole flow control device according to claim 1, wherein the engagement element is spring-loaded.

9. The downhole flow control device according to claim 1, further comprising a first sealing element and a second sealing element, the first sealing element being arranged in a first circumferential groove in the base tubular on a first side of the first opening and the second sealing element being arranged in a second circumferential groove in the base tubular on a second side of the first opening, the second side being opposite the first side.

10. The downhole flow control device according to claim 9, wherein the first sealing element is arranged between the first sleeve part and the base tubular, and the second sealing element is arranged between the first sleeve part and the base tubular in the first position and between the second sleeve and the base tubular in the second position.

11. The downhole flow control device according claim 1, wherein the first sleeve part and the second sleeve part are produced as one sleeve.

12. The downhole flow control device according to claim 1, wherein the first sleeve part is a third sleeve which is connected with the second sleeve part.

13. The downhole flow control device according to claim 1, wherein the first sleeve part has a first end and a second end, and the second sleeve has a first end and a second end, the first end of the first sleeve part abutting the second end of the second sleeve in the first position.

14. The downhole flow control device according to claim 13, wherein a gap is formed between the second end of the second sleeve and the first end of the first sleeve part when the second sleeve is prevented from movement in the first direction and the first sleeve part continues to move past the first opening, whereby fluid communication between the first opening and the second opening is provided via the gap.

15. The downhole flow control device according to claim 1, wherein the second sleeve part has an inner face and a groove in the inner face for engagement with a key tool of a downhole tool.

16. The downhole flow control device according to claim 1, wherein the flow control device is a frac port or an inflow control device or a valve.

17. A downhole system for controlling a flow of a fluid from a borehole into a well tubular structure and/or from the well tubular structure into the borehole, comprising:

a well tubular structure, and the downhole flow control device according to claim 1.

18. The downhole system according to claim 17, further comprising an annular barrier, the annular barrier comprising:

a tubular part adapted to be mounted as part of the well tubular structure, the tubular part having an outer face, an expandable sleeve surrounding the tubular part and having an inner sleeve face facing the tubular part and an outer sleeve face facing the wall of the borehole, each end of the expandable sleeve being connected with the tubular part, and an annular space between the inner sleeve face of the expandable sleeve and the tubular part.

19. The downhole system according to claim 18, wherein the annular barrier is a first annular barrier and the system further comprises a second annular barrier, both adapted to be expanded in an annulus between the well tubular structure and a wall of the borehole or another well tubular structure downhole for providing zone isolation of a production zone positioned between the first and second annular barriers, the downhole flow control device being arranged opposite the production zone.

* * * * *